US009108783B2

(12) United States Patent
Suzuki

(10) Patent No.: US 9,108,783 B2
(45) Date of Patent: Aug. 18, 2015

(54) EXTRACTION BAG AND PACKAGING MATERIAL SHEET

(75) Inventor: Yasuhiko Suzuki, Kikugawa (JP)

(73) Assignee: FUSO INDUSTRY CO., LTD, Kikugawa-Shi, Shizuoka (JP)

( * ) Notice: Subject to any disclaimer, the term of this patent is extended or adjusted under 35 U.S.C. 154(b) by 217 days.

(21) Appl. No.: 13/699,656

(22) PCT Filed: Jun. 17, 2010

(86) PCT No.: PCT/JP2010/004024

§ 371 (c)(1),
(2), (4) Date: Nov. 23, 2012

(87) PCT Pub. No.: WO2011/158293

PCT Pub. Date: Dec. 22, 2011

(65) Prior Publication Data

US 2013/0062224 A1 Mar. 14, 2013

(51) Int. Cl.

| | |
|---|---|
| ***B65D 85/00*** | (2006.01) |
| ***B65D 81/00*** | (2006.01) |
| ***B65D 85/812*** | (2006.01) |
| ***B65B 29/04*** | (2006.01) |

(52) U.S. Cl.

CPC ..... *B65D 81/00* (2013.01); *B65B 29/04* (2013.01); *B65D 85/812* (2013.01)

(58) Field of Classification Search

CPC . B65D 85/808; B65D 85/8046; B65D 85/812
USPC ..... 206/0.5; 426/77, 82, 83
See application file for complete search history.

(56) References Cited

U.S. PATENT DOCUMENTS

| | | | | |
|---|---|---|---|---|
| 5,552,164 | A * | 9/1996 | Kuipers et al. | 426/80 |
| 5,552,165 | A | 9/1996 | Haak et al. | |
| 5,632,132 | A | 5/1997 | Kuipers et al. | |
| 5,672,368 | A * | 9/1997 | Perkins | 426/83 |
| 5,674,544 | A * | 10/1997 | Shakspeare | 426/80 |
| 5,863,575 | A | 1/1999 | Kuipers et al. | |
| 5,882,472 | A * | 3/1999 | Vernon et al. | 156/436 |
| 7,404,789 | B2 * | 7/2008 | Rea et al. | 493/375 |
| 2008/0081090 | A1 * | 4/2008 | Mayr et al. | 426/77 |

FOREIGN PATENT DOCUMENTS

| | | |
|---|---|---|
| JP | A-8-500310 | 1/1996 |
| JP | A-9-503727 | 4/1997 |

(Continued)

OTHER PUBLICATIONS

Sep. 21, 2010 International Search Report issued in International Application No. PCT/JP2010/004024 (with translation).

*Primary Examiner* — Luan K Bui
*Assistant Examiner* — Rafael Ortiz
(74) *Attorney, Agent, or Firm* — Oliff PLC

(57) ABSTRACT

An extraction bag is disclosed that has a body that can be squeezed using hanging threads. A portion of a sheet body is folded back, and point seals are provided in the folded-back area. Two hanging threads are attached with the point seals as supporting points. Then, when the hanging threads are pulled in opposite directions, the direction of the one hanging thread is guided during pulling by the point seals and the end of an edge seal as supporting points, and the direction of the other hanging thread of a tag-attached hanging thread is guided during pulling by the point seals and the end of an edge seal as supporting points. By this means, the point seals are first pulled towards one another and then the base seals of the threads are also pulled towards one another, thereby squeezing the bag body from three dimensional directions.

7 Claims, 9 Drawing Sheets

(56) References Cited

FOREIGN PATENT DOCUMENTS

| | | |
|---|---|---|
| JP | A-2008-150071 | 7/2008 |
| WO | WO 93/19997 | 10/1993 |
| WO | WO 95/10461 | 4/1995 |
| WO | WO 95/10462 | 4/1995 |
| WO | WO 95/13231 | 5/1995 |

* cited by examiner

EXTRACTION BAG AND PACKAGING MATERIAL SHEET

TECHNICAL FIELD

The present invention relates to an extraction bag including a tag-attached hanging thread, and a packaging material sheet for manufacturing a bag body of the extraction bag.

BACKGROUND ART

In the related art, an extraction bag for extraction of tea leaves or the like is known, and JP-A-2008-150071 discloses a typical type thereof, which is formed of a bag body in which tea leaves or the like are filled, and a hanging thread of which the base end side is fixed to the bag body and a tag is fixed to the free end side.

In a case of extracting tea leaves or the like by using this extraction bag, the tag is held by hand, and the bag body is put in a cup with hot water or the like to extract tea or the like in the water. Then, after the extraction, the tag is lifted to remove the bag body from the cup and discard it by putting into a trash can or the like.

CITATION LIST

Patent Literature

[PTL 1] JP-A-2008-150071
[PTL 2] JP-T-8-500310

SUMMARY OF INVENTION

Technical Problem

A lot of water remains in the bag body after being taken from the cup or the like as described above, and it is difficult to sufficiently drain the bag even by vertically shaking the hanging thread.

Therefore, it is necessary when discarding to bring the bag to a trash can or the like, while putting a hand under the bag body to catch the drips, and is inconvenient, as the hand became dirty.

In addition, the water remaining in the bag body is rich in flavor by sufficiently extracting the tea or the like, however, the extract is needlessly discarded.

In an infusion package disclosed in JP-T-8-500310, the majority of a hanging thread is held in a bag body, and both ends thereof are drawn to the outside. In this infusion package, when both ends are pulled in opposite directions, tea leaves or the like filled therein are drained by being squeezed.

However, in the infusion package of this type, the draining is insufficient, and in addition, since the hanging thread is held in the bag body and extrudes from the bag body to the outside, it is not possible to use a package film in a conventional form-fill-sealing machine disclosed in JP-A-2008-150071 to perform package filling.

The present invention has been made to address the aforementioned problems and aims at providing an extraction bag which is capable of completely and sufficiently squeezing tea leaves or the like filled in a bag body, and performing package filling using a conventional form-fill-sealing machine of the related art. In addition, the present invention aims at providing a packaging material sheet for manufacturing the bag body of the extraction bag described above.

Solution to Problem

The present invention has been made to address the aforementioned problems. A first aspect of the invention is to provide an extraction bag including: a bag body which is packaged by sealing a packaging material having flexibility; a cover material which is covered on the outer surface of the packaging material, and is integrated with the packaging material by edge sealing portions formed on a pair of opposing edges thereof; point sealing portions, at least one of which is provided on both inner sides of the edge sealing portions, and which point-seals the cover material and the packaging material; and two hanging threads of which base end sides are sealed in the bag body or the cover material to form a base end sealing portion, in which one hanging thread is drawn so that both sides of the point sealing portions and an edge end of one edge sealing portion become supporting points when pulling, and another hanging thread is drawn so that both sides of the point sealing portions and an edge end of another edge sealing portion become supporting points when pulling, and when pulling the hanging thread towards outside of one side and the other hanging thread towards outside of the other side, in opposite directions to each other, and the packaging material is squeezed by the base end sealing portion and the point sealing portion approaching one position.

A second aspect of the invention is to provide the extraction bag according to the first aspect 1, in which the cover material and the packaging material are configured of the same material, a sealing portion for packaging the packaging material is overlapped with the edge sealing portion.

A third aspect of the invention is to provide the extraction bag according to the first or second aspect, in which two point sealing portions are provided on both sides of the edge sealing portion, respectively, and are commonly used as supporting points for each of the two hanging threads.

A fourth aspect of the invention is to provide the extraction bag according to any one of the first to third aspects, in which the extraction bag is in a triangular pyramid, the point sealing portions are disposed on one triangular surface, the base end sealing portion of any one of the hanging threads is disposed on any one of apexes or in a vicinity thereof of the triangular surface, and traces an S in the vicinity of both sides of the point sealing portions, and the base end sealing portion of the remaining hanging thread is disposed on an apex or in a vicinity thereof, which is surrounded by three remaining triangular surfaces other than the triangular surface described above, and traces a U in the vicinity of both sides of the point sealing portions.

A fifth aspect of the invention is to provide the extraction bag according to any one of the first to fourth aspects, in which the two hanging threads are tag-attached threads, and tags are adjacent to each other and are temporarily sealed with respect to the packaging material.

A sixth aspect of the invention is to provide a packaging material sheet which is continuously elongated and used for packaging in the bag body of the extraction bag according to any one of the first to fifth aspects, in which one end side of the packaging material sheet in a short direction is formed by being folded back, and when an edge and another end edge of the folded portion are joined to each other to be vertically sealed and transversally sealed in a direction intersecting thereto, the packaging is performed, and a folded piece in which the edge sealing portion is formed by the transversal sealing is integrated with the packaging material as the cover material.

A seventh aspect of the invention is to provide the packaging material sheet according to the sixth aspect, in which the base end sealing portion of one tag-attacked hanging thread is provided between the folded portions and traces an S in the vicinity of both sides of two point sealing portions, and the base end sealing portion of the other hanging thread is provided on the packaging material sheet which is exposed to the outside and traces a U in the vicinity of both sides of two point sealing portions.

Advantageous Effects of Invention

According to the extraction bag of the present invention, it is possible to completely squeeze the material to be extracted filled in the bag body. In addition, the extraction bag can be manufactured by package filling using a conventional form-fill-sealing machine.

BRIEF DESCRIPTION OF DRAWINGS

FIG. 10 is a view for explaining a state where a bag body is squeezed, subsequently from FIG. 9.

DESCRIPTION OF EMBODIMENTS

Figure 1:
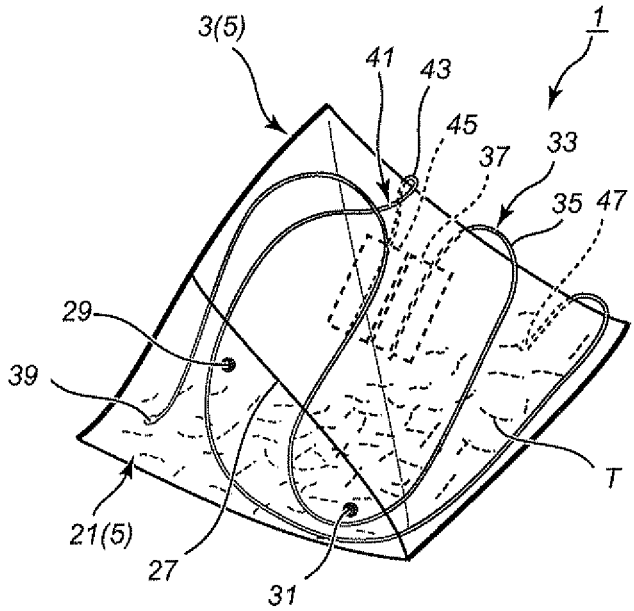
FIG. 1 is a perspective view of an extraction bag according to an embodiment of the present invention.

An extraction bag 1 according to a first embodiment of the present invention will be described referring to the drawings.

First, a configuration of the extraction bag 1 will be described according to FIGS. 1 and 2.

Figure 2:
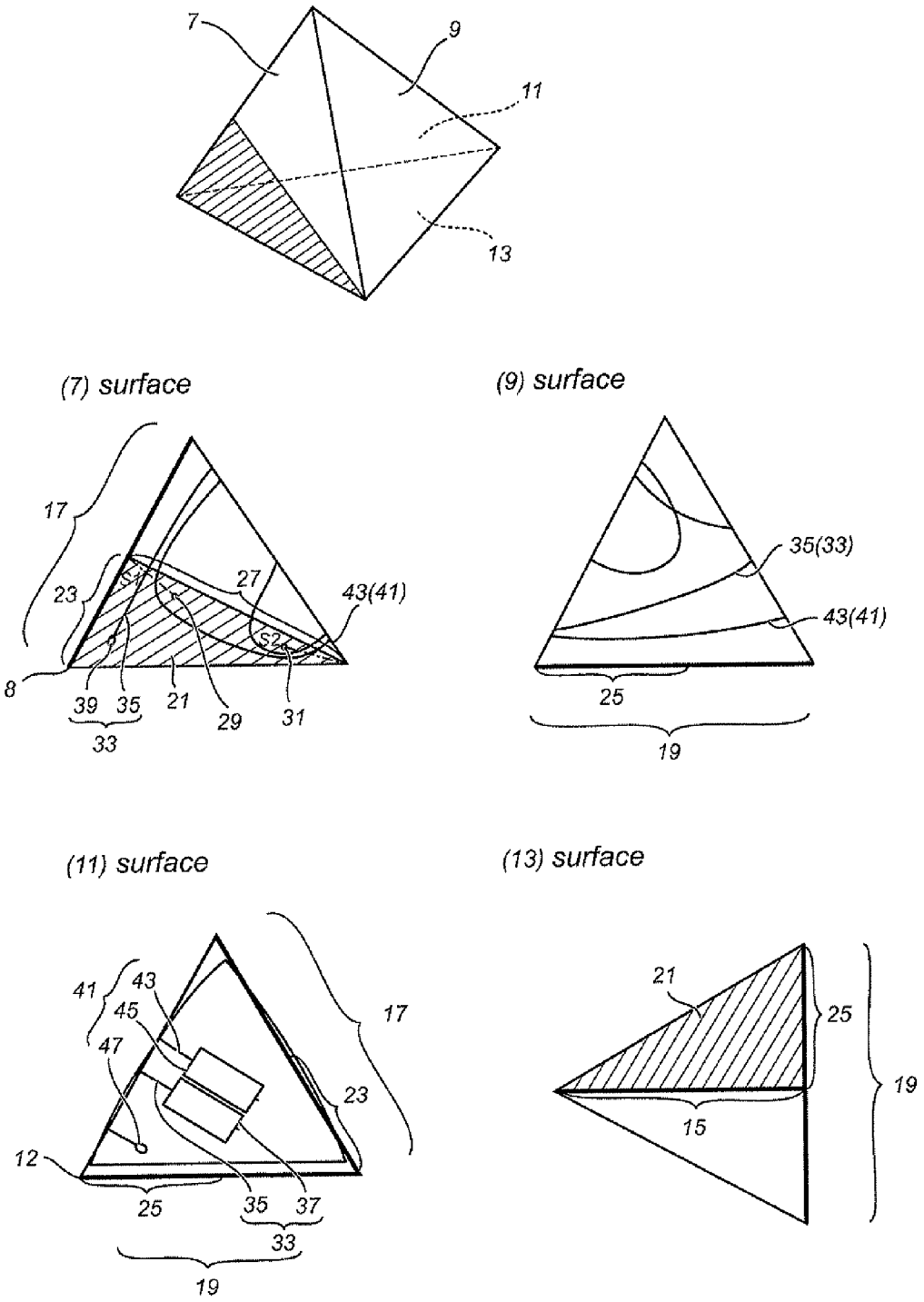
FIG. 2 is four orthogonal views of a bag body configuring an extraction bag of FIG. 1.

In FIG. 1, reference numeral 3 denotes a bag body, and the bag body 3 is formed by joining and sealing rectangular edges of a flexible packaging material, and is three-dimensionally formed in a triangular pyramid shape with four triangular surfaces 7, 9, 11, and 13 shown in FIG. 2. Sealing portions include a vertical sealing portion 15 and transversal sealing portions 17 and 19.

In the bag body 3, tea leaves T as a material to be extracted are being filled.

Reference numeral 21 denotes a cover material, the material of the cover material 21 is the same as the packaging material configuring the bag body 3. The cover material 21 has a rectangular shape of a small size. The cover material 21 covers partially two triangular surfaces 7 and 13 of the bag body 3. Edges of three sides of the cover material 21 are sealed with respect to the bag body 3 to form edge sealing portions, and the edge sealing portions are formed at the same time with the vertical sealing portion 15 and the transversal sealing portions 17 and 19 by being overlapped therewith. That is, the sealing portions are for the bag body 3 as well as for cover material 21. In the drawing, the edge sealing portion thus formed by being overlapped with the transversal sealing portion 17 is denoted by reference numeral 23, and an edge sealing portion thus formed by being overlapped with the transversal sealing portion 19 is denoted by reference numeral 25, to be distinguished from each other.

Meanwhile, the remaining side is not sealed and opened to form an opening portion 27, and the cover material 21 is formed in a pocket-like shape and integrated with respect to the bag body 3.

Reference numerals 29 and 31 denote point sealing portions, and the point sealing portions 29 and 31 seal the cover material 21 and the triangular surface 7 of the bag body 3 punctiformlly. The point sealing portions 29 and 31 are provided on the inner side of the edge sealing portion 23 and the inner side of the edge sealing portion 25, respectively. In addition, the point sealing portions 29 and 31 are disposed in positions which are closer to the opening portion 27 by the same degree.

Accordingly, the dimensions of an outlet S1 between the point sealing portion 29 and the edge end of the edge sealing portion 23 and the dimensions of an outlet S2 between the point sealing portion 31 and the edge end of the edge sealing portion are approximately the same, and both have dimensions sufficient for both of hanging threads 35 and 43 of the tag-attached hanging threads 33 and 41, described later, to pass through together.

The tag-attached hanging thread 33 is formed of the hanging thread 35 and a tag 37 which is attached to one end side thereof, and the tag-attached hanging thread 41 is formed of the hanging thread 43 and a tag 45 which is attached to the end side thereof. Although reference numerals thereof are different for the purpose of differentiation, the two tag-attached hanging threads have the same structure and material.

The base end side of the tag-attached hanging thread 33 is sealed to the cover material 21 in a vicinity of an apex 8 of the triangular surface 7 to form a base end sealing portion 39. After the hanging thread 35, which is extended from the base end sealing portion 39, traces a big S in the vicinity of the point sealing portions 29 and 31, the hanging thread 35 is extended to the outside of pocket from the outlet S2, traverses the triangular surface 9, and extends to the inside of the triangular surface 11, and the tag 37 is temporarily sealed to the triangular surface 11.

The base end side of the tag-attached hanging thread 41 is sealed in the vicinity of an apex 12 (that is, the apex surrounded by the triangular surfaces 9, 11, and 13) above the triangular surface 11 to form a base end sealing portion 47. After the hanging thread 43, which is extended from the base end sealing portion 47, traces a big U in the vicinity of the point sealing portions 31 and 29, the hanging thread is extended to the outside of the pocket from the outlet S1, traverses the triangular surface 9, and extends to the inside of the triangular surface 11, and the tag 45 is temporarily sealed with respect to the triangular surface 11 in a state where the tag is adjacent to the tag 37.

Figure 3:
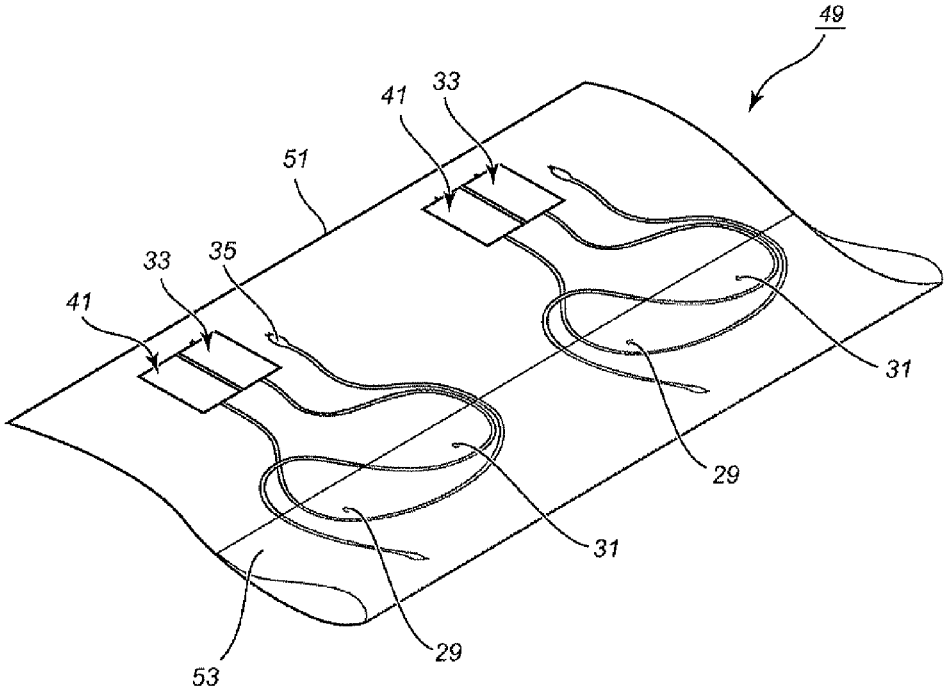
FIG. 3 is a perspective view of a packaging material sheet used for manufacturing an extraction bag of FIG. 1.

A configuration of a packaging material sheet 49 which is continuously elongated and used for packaging in the bag body 3 of the extraction bag 1 will be described according to FIGS. 3 and 4.

Reference numeral 51 denotes a continuous elongated sheet body. The sheet body 51 is a sheet body obtained when one piece of packaging material 5 configuring the bag body 3 described above is continued in the longitudinal direction.

One end side of the sheet body 51 in the short direction is folded back to be formed as a folded piece 53, a length of the folded piece in the short direction is in a degree to exceed a bit of ¼ of the length of the sheet body 51 in the short direction before being folded.

A dotted-line portion t1 of both right and left sides is the vertical sealing and cutting portion 15, and a dotted-line portion t2 of both top and bottom is the transversal sealing and cutting portions 17 and 19. When the packaging is performed, the folded piece 53 becomes the cover material 21, and an edge 55 of the folded piece 53 becomes the opening portion 27.

Figure 4:
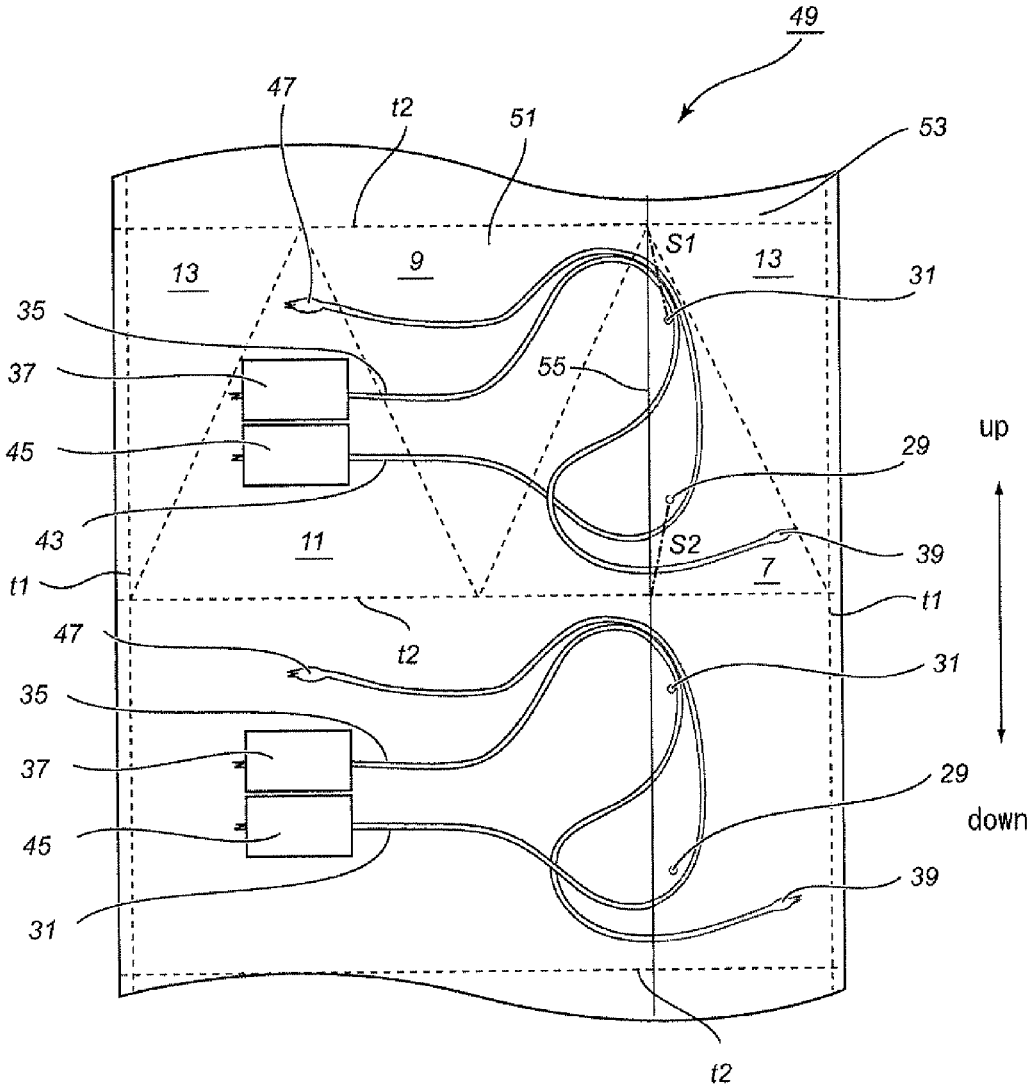
FIG. 4 is a top view of a packaging material sheet used for manufacturing an extraction bag of FIG. 1.

By performing the packaging, it is assumed that triangles defined by dotted-lines in FIG. 4 become the triangular surfaces 7, 9, 11, and 13 after forming three-dimensionally, and the point sealing portions 29 and 31, the tag-attached hanging thread 33 (hanging thread 35, tag 37, and base end sealing portion 39), the tag-attached hanging thread 41 (hanging thread 43, tag 45, and base end sealing portion 47) are attached using the disposition shown in the drawing.

Since the hanging threads 35 and 43 are disposed between t2 and t2 which are adjacent to each other vertically, even when the cutting is performed at t2, the hanging threads are not cut along with t2.

Next, the packaging of the packaging material sheet 49 described above will be described according to FIGS. 5 and 6.

Figure 5:
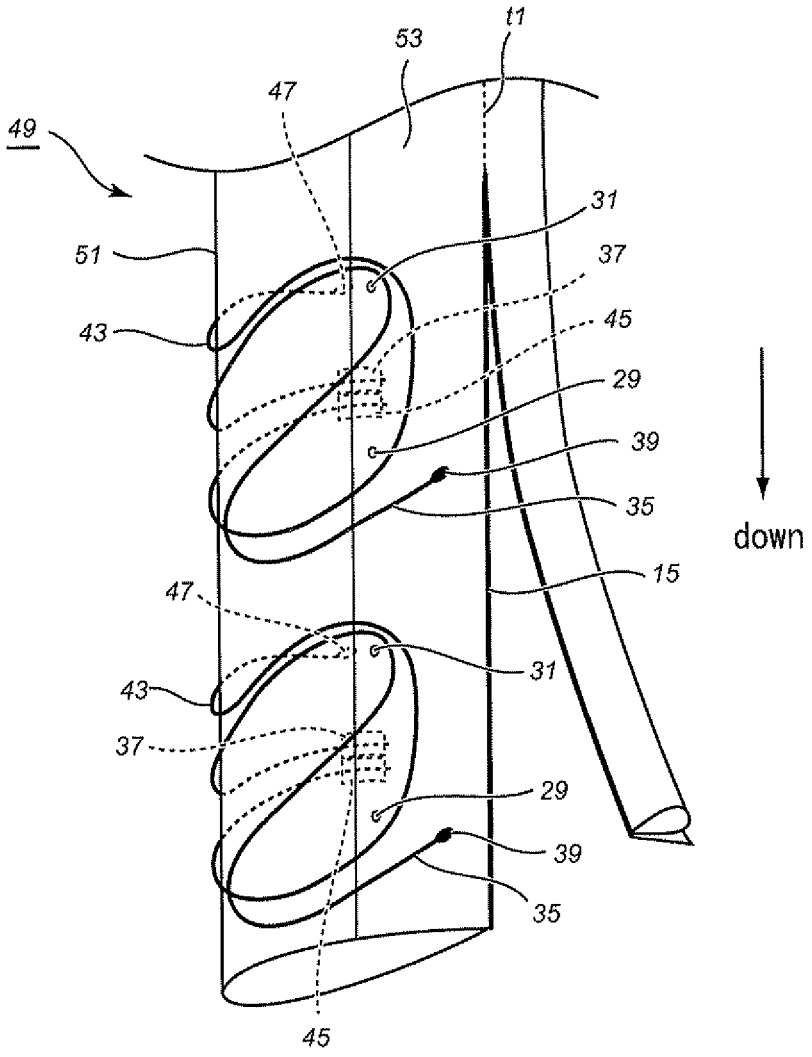
FIG. 5 is an explanatory view of a process of packaging of an extraction bag of FIG. 1.
Figure 6:
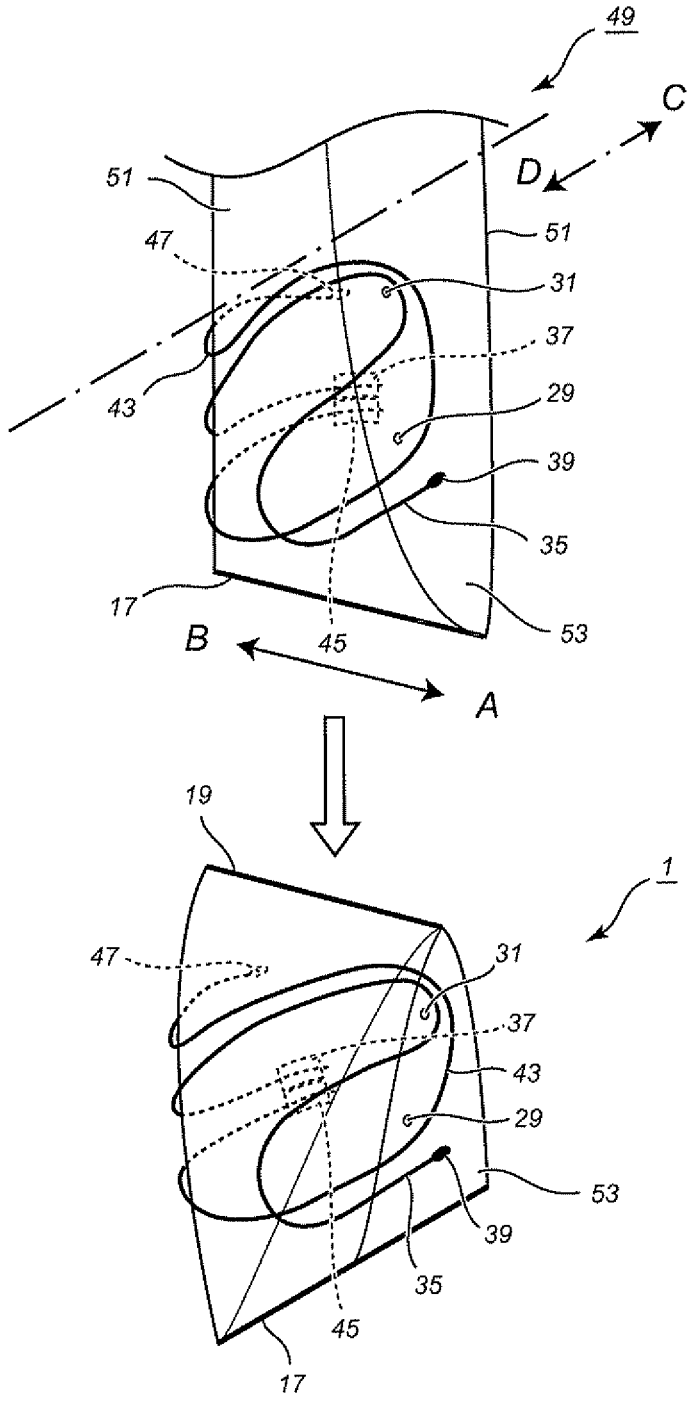
FIG. 6 is an explanatory view of a process of packaging of an extraction bag, subsequently from FIG. 5.

As shown in FIG. 5, the packaging material sheet 49 is transferred to the lower side, and in that process, the packaging by the sealing and cutting and the filling of the tea leaves T are performed, however, for convenience of visibility, a drawing regarding the filling process and filling state of the tea leaves T is omitted.

First, edges of both sides in the short direction, that is, an edge of the folded portion and an edge of the other end side opposed thereto are joined to each other, to execute sealing and cutting along the overlapped t1 in the longitudinal direction, and the vertical sealing portion 15 is obtained. Accordingly, the sheet body 51 is formed in a tubular shape.

After that, the sealing and cutting is executed in the A-B direction which is the transversal direction, to form the transversal sealing portion 17 in the lower side. Then, after filling the tea leaves T, sealing and cutting is executed in the C-D direction which is perpendicular to the A-B direction, to form the transversal sealing portion 19 in the upper side. The transversal sealing portion 19 is formed in the upper side of one bag body 3, and the transversal sealing portion 17 is formed in the lower side of the subsequent bag body 3. The packaging material sheet 49 continuously makes the bag bodies 3.

Accordingly, the extraction bag 1 is manufactured in which two tag-attached hanging threads 33 and 41 are attached to the bag body 3.

Next, a method of using the extraction bag 1 will be described according to FIGS. 7 to 10.

Figure 7:
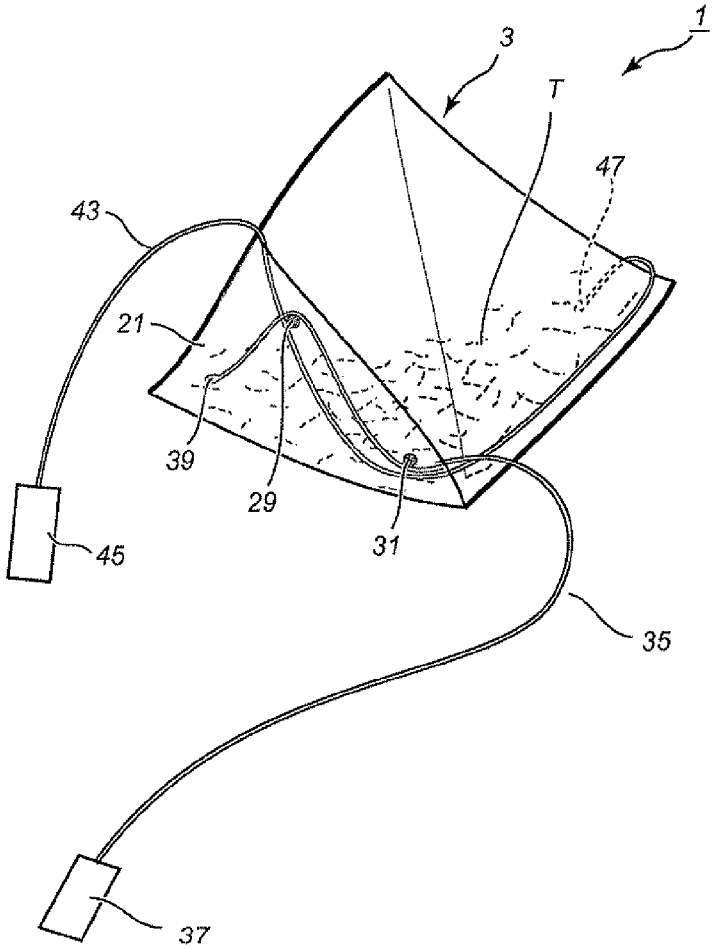
FIG. 7 is a view showing a state where a tag of an extraction bag of FIG. 1 is peeled off.

As shown in FIG. 7, the tags 37 and 45 are peeled off from the bag body 3. Then, when hanging the bag body 3 by holding the tags 37 and 45, the bag body 3 is put in a cup with hot water. Next, after extracting components from the tea leaves T to a certain extent, the tags 37 and 45 are lifted to remove the bag body 3 from the cup.

Figure 8:
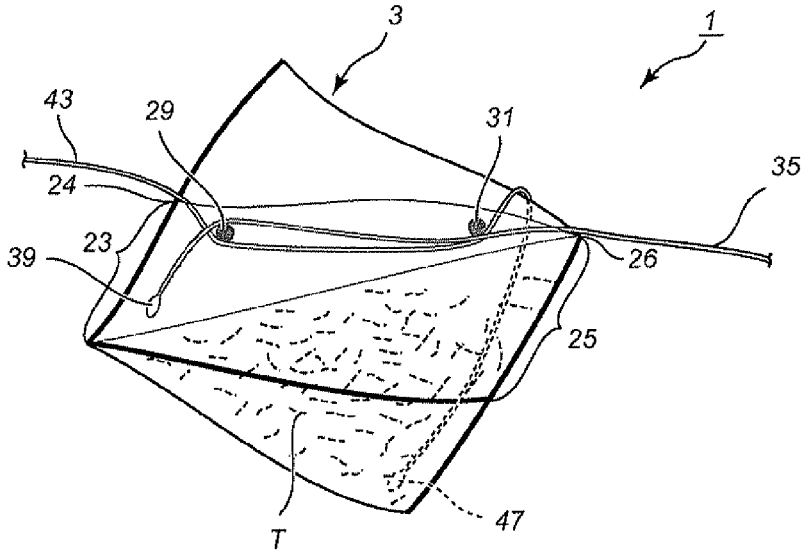
FIG. 8 is an explanatory view of a squeezing operation of a bag body of an extraction bag of FIG. 1.

After that, as shown in FIG. 8, when the tags are pulled in the opposite direction respectively, that is, when the tag 37 is pulled to the right and the tag 45 is pulled to the left, the hanging thread 35 of the tag-attached hanging thread 33 is pulled while being guided by setting the point sealing portions 29 and 31 and an edge end 26 of the edge sealing portion as supporting points, the hanging thread 43 of the tag-attached hanging thread 41 is pulled while being guided by setting the point sealing portions 31 and 29 and an edge end 24 of the edge sealing portion 23 as supporting points.

Figure 9:
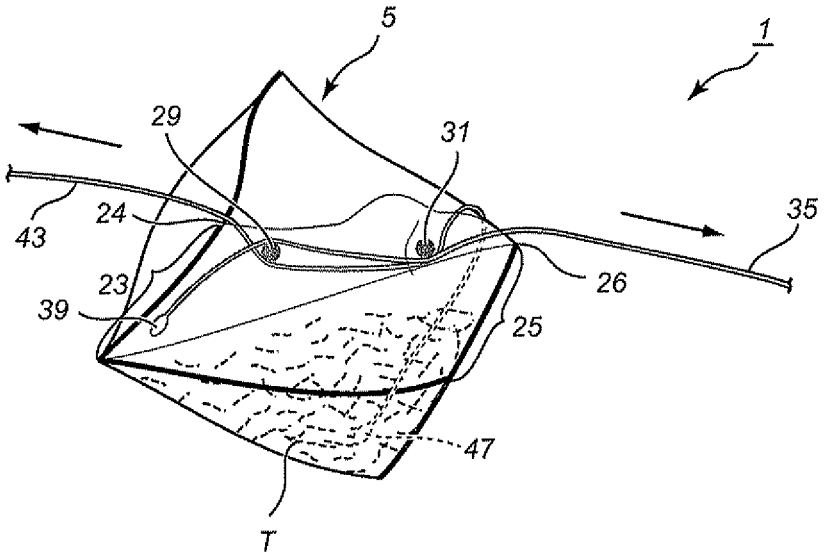
FIG. 9 is a view for explaining a state where a bag body of an extraction bag of FIG. 1 is squeezed.
Figure 1:
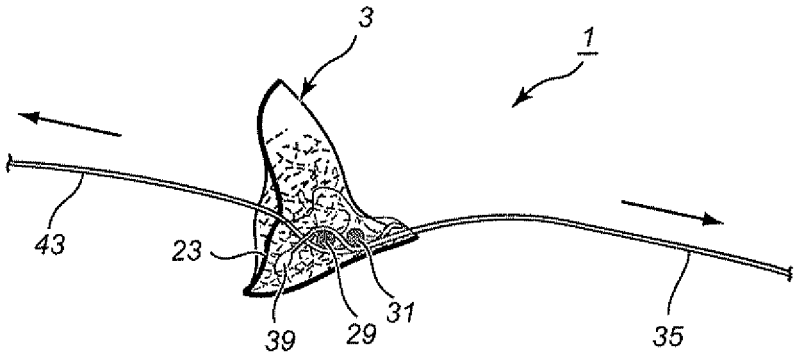

Since the point sealing portions 29 and 31 are commonly used as supporting points, and the orbits of the hanging thread 35 and the hanging thread 43 on the triangular surface 7 are substantially in parallel to each other, as shown in FIG. 9, the point sealing portion 29 and the point sealing portion 31 approach each other, and the packaging material 5 in the vicinity thereof is squeezed.

Further, as shown in FIG. 10, the base end sealing portion 39 is pulled to the point sealing portion 29, the base end sealing portion 47 is pulled to the point sealing portion 31, and the packaging material 5 in the vicinity thereof is squeezed.

As described above, since the bag body 3 is squeezed from directions in three dimensions, the tea leaves T can be completely and sufficiently squeezed.

Accordingly, it is possible to drop the last of the extract into the cup. In addition, since the water does not drip, it is not necessary to put a hand under the bag body when discarding it.

Figure 11:
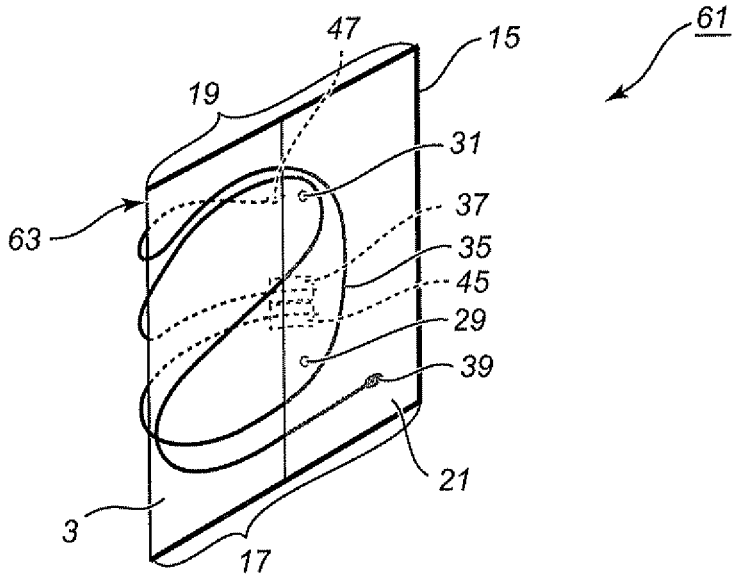
FIG. 11 is a perspective view of an extraction bag according to a second embodiment.

An extraction bag 61 according to a second embodiment of the present invention will be described according to FIG. 11.

The extraction bag 61 is in a flat-package shape, and may be manufactured by performing the transversal sealing and cutting always in the A-B direction, when performing the packaging of the sheet body 51.

As described above, the bag body 63 may be in a flat-package shape.

Hereinabove, the embodiments of the present invention have been described, however the detailed configuration is not limited to the embodiments, and design modifications in a range not departing from the gist of the present invention are included in the invention.

For example, the tags of the two tag-attached hanging threads may be in a configuration in which the tags may be integrated in an initial state, and may be separated when pulling the respective hanging threads in opposite directions after the extraction.

INDUSTRIAL APPLICABILITY

The present invention can be used in the manufacturing of an extraction bag, or a packaging material sheet for manufacturing a bag body of an extraction bag.

REFERENCE SIGNS LIST

1; EXTRACTION BAG (FIRST EMBODIMENT)
3: BAG BODY
5: PACKAGING MATERIAL
7, 9, 11, 13: TRIANGULAR SURFACE
15: VERTICAL SEALING PORTION
17, 19: TRANSVERSAL SEALING PORTION
21: COVER MATERIAL
23, 25: EDGE SEALING PORTION
24, 26: END EDGE (OF EDGE SEALING PORTION)
27: OPENING PORTION
29, 31: POINT SEALING PORTION
33: TAG-ATTACHED HANGING THREAD
35: HANGING THREAD
37: TAG
39: BASE END SEALING PORTION
41: TAG-ATTACHED HANGING THREAD
43: HANGING THREAD
45: TAG
47: BASE END SEALING PORTION
49: PACKAGING MATERIAL SHEET
51: SHEET BODY
53: FOLDED PIECE
55: EDGE (OF FOLDED PIECE)

61: EXTRACTION BAG (SECOND EMBODIMENT)

63: BAG BODY

T: TEA LEAVES

The invention claimed is:

1. An extraction bag comprising:

a bag body that is packaged by sealing of a flexible packing material;

a cover material that covers an outer surface of the packing material, and is sealed to the packaging material by edge sealing portions formed on a pair of opposing edges of the packaging material;

point sealing portions, at least one of the point sealing portions is provided on both inner sides of the edge sealing portions, and the point sealing portions point-seal the cover material and the packaging material; and two hanging threads having base end sides that are sealed in the bag body or the cover material to form a base end sealing portion, wherein:

a first hanging thread is drawn so that both sides of the point sealing portions and a first edge end of a first edge sealing portion become supporting points when pulling, and a second hanging thread is drawn so that both sides of the point sealing portions and a second edge end of the second edge sealing portion become supporting points when pulling, the first hanging thread passes between the first edge sealing portion and the point sealing portions; and the second hanging thread passes between each point sealing portion, when pulling the first hanging thread towards outside of one side and the second hanging thread towards outside of the other side, in opposite directions to each other, and the packaging material is squeezed by the base end sealing portion and the point sealing portion approaching one position.

2. The extraction bag according to claim 1, wherein the cover material and the packaging material are made of the same material, and a transversal sealing portion is overlapped with the edge sealing portion.

3. The extraction bag according to claim 1, wherein two point sealing portions are provided on both sides of the edge sealing portion, respectively, and are commonly used as supporting points for each of the two hanging threads.

4. The extraction bag according to claim 1, wherein the extraction bag is in a triangular pyramid shape, the point sealing portions are disposed on one triangular surface, the base end sealing portion of any one of the hanging threads is disposed on any one of apexes or in a vicinity thereof of the triangular surface, and traces an S in the vicinity of both sides of the point sealing portions, and the base end sealing portion of the remaining hanging thread is disposed on an apex or in a vicinity thereof, which is surrounded by three remaining triangular surfaces other than the triangular surface described above, and traces a U in the vicinity of both sides of the point sealing portions.

5. The extraction bag according to claim 1, wherein the two hanging threads are tag-attached threads, and the tag-attached threads are adjacent to each other and are temporarily sealed within the packaging material.

6. A packaging material sheet which is continuously elongated and used for packaging in the bag body of the extraction bag according to claim 1, wherein one end side of the packaging material sheet in a short direction is formed by being folded back, and when an edge and another end edge of the folded portion are joined to each other to be vertically sealed and transversally sealed in a direction intersecting thereto, the packaging is performed, and a folded piece in which the edge sealing portion is formed by the transversal sealing is integrated with the packaging material as the cover material.

7. The packaging material sheet according to claim 6, wherein the base end sealing portion of one tag-attached hanging thread is provided between the folded portions and traces an S in the vicinity of both sides of two point sealing portions, and the base end sealing portion of the other hanging thread is provided on the packaging material sheet which is exposed to the outside and traces a U in the vicinity of both sides of two point sealing portions.

* * * * *